US005526032A

United States Patent [19]

Nakamura

[11] Patent Number: 5,526,032

[45] Date of Patent: Jun. 11, 1996

[54] METHOD FOR PROCESSING A STENCIL MASTER PLATE BY USING A THERMAL HEAD

[75] Inventor: Jun Nakamura, Tokyo, Japan

[73] Assignee: Riso Kagaku Corporation, Tokyo, Japan

[21] Appl. No.: 851,641

[22] Filed: Mar. 16, 1992

[30] Foreign Application Priority Data

Apr. 10, 1991 [JP] Japan ..... 3-077696

[51] Int. Cl.[6] ..... B41J 2/325; B41J 2/355

[52] U.S. Cl. ..... 347/211; 347/171

[58] Field of Search ..... 346/76 PH, 76 R; 400/120; 404/114; 101/127, 128.21, 128.4, 129; 347/171, 211

[56] References Cited

U.S. PATENT DOCUMENTS

| | | | |
|---|---|---|---|
| 4,957,378 | 9/1990 | Shima | 400/120 |
| 5,140,898 | 8/1992 | Igarashi | 101/128.4 |
| 5,186,102 | 2/1993 | Kanno et al. | 101/128.4 |

FOREIGN PATENT DOCUMENTS

| | | |
|---|---|---|
| 130612 | 3/1986 | European Pat. Off. . |
| 349812 | 1/1990 | European Pat. Off. . |
| 3940561 | 8/1990 | Germany . |
| 2032215 | 4/1980 | United Kingdom . |

*Primary Examiner*—Huan H. Tran
*Attorney, Agent, or Firm*—Dickstein, Shapiro & Morin

[57] ABSTRACT

In processing a stencil master plate by making perforations in the manner of a dot matrix on a heat sensitive film of a thermal stencil master plate by using a thermal head having plural minute heat elements, perforations in a solid dark region of the dot matrix are omitted at a prescribed ratio if the dark region extends over 3×3 dots or larger, except for a peripheral part of the region. Through appropriate control of the amount of ink that passes through the perforations at the time of printing, and prevention of the blockage of the perforations achieved by thus optimizing the distribution of the perforations, offsetting, unevenness in density, and other problems detrimental to a favorable print quality may be eliminated without regard to the pattern of the original images.

12 Claims, 9 Drawing Sheets

METHOD FOR PROCESSING A STENCIL MASTER PLATE BY USING A THERMAL HEAD

TECHNICAL FIELD

The present invention relates to a method for processing a stencil master plate for stencil printing, and in particular to such a method for processing a stencil master plate by making perforations in the manner of a dot matrix on a heat sensitive film of a thermal stencil master plate by using a thermal head.

BACKGROUND OF THE INVENTION

According to a conventional method for processing a stencil master plate for stencil printing, an original image is photo-electrically scanned with an image sensor, and the density of the image is converted into a binary signal for each pixel so that the heat sensitive film of thermo-plastic resin of the thermal stencil master plate may be perforated in the manner of a dot matrix by selectively heating each of the minute heat elements of a thermal head according to the obtained binary digital signal representing the image.

In such a method for processing a stencil master plate, when the image signal is converted into a binary signal according to a fixed threshold level, for instance, in case of a character image, all of the minute heat elements of the thermal head corresponding to the region judged to be "black" are heated, and each and every dot in such a region of the film is perforated with the minute heat elements.

Conventionally, perforation of the heat sensitive film with the minute heat elements of the thermal head is carried out without regard to the size, shape or position of the region which is judged to be "black". Therefore, in the black region or the solid dark region extending both in horizontal and vertical scanning directions, the minute heat elements of the thermal head are continuously driven, and this may lead to an over-heated condition. In this case, an amount of heat that is more than required for the perforation on the heat sensitive film is applied, and accordingly the heat sensitive film is subjected to an excessive heat shrinkage for the intended size of perforations.

In such a case, and in the solid region, the gaps between the perforated dots on the heat sensitive film may totally disappear, i.e., the perforated dots may be merged with each other. Therefore, an excessive ink deposition on the printing paper in this region and the problem of offsetting may occur.

Further, the part of the heat sensitive film situated in the gaps which are almost disappeared by excessive heat shrinking between perforated dots may be locally torn apart in its molten state from the adherence to the support of the thermal stencil master plate, and may clog the perforations up by sticking to the fibers of the support which the molten film encounters during the process of thermal perforation. This may cause localized loss in density or blur in the printed image.

Also, since the heat emitting condition of the minute heat elements of the thermal head may vary from one to another depending on the pattern of the image, the shape and the perforating efficiency may vary from one point on the stencil master plate to another, and the images of solid or fine characters may not be reproduced on the printing paper in a satisfactory fashion.

BRIEF SUMMARY OF THE INVENTION

In view of such problems of the prior art, a primary object of the present invention is to provide a method for processing a stencil master plate which can prevent the occurrence of offsetting by appropriately controlling the ink deposition, eliminate the occurrence of the localized loss of density by preventing the clogging of the perforations, and achieve a satisfactory print quality not depending on the pattern of the original image through optimization of the perforation in the solid image region of the heat sensitive film.

This and other objects of the present invention can be accomplished by providing a method for processing a stencil master plate by making perforations in the manner of a dot matrix on a heat sensitive film of a thermal stencil master plate by using a thermal head having plural minute heat elements, comprising the step of: omitting perforations in a solid dark region of the dot matrix at a prescribed ratio if such a region extends over 3×3 dots or larger, except for a peripheral part of the region.

By doing so, it becomes possible to avoid the situation in which the minute heat elements of the thermal head are driven and heated continuously for an extended period of time, and an excessive amount of heat is accumulated in the minute heat elements or their neighbourhood. Therefore, it can be avoided that the minute heat elements are overheated and that the excessive heat beyond required for the perforation is applied to the heat sensitive film. Accordingly, the generation of excessively large perforations in the heat sensitive film can be avoided. By thus optimizing the distribution of the perforations, the detrimental phenomena to a favorable print quality such as offsetting, unevenness in density, and other problems may be eliminated without regard to the pattern of the original images.

According to a more specific aspect of the present invention, the perforation ratio which is given as a ratio of a number of perforations to a number of matrix dots in the region may be in the range of 50%≦ the perforation ratio <100%, and this ratio may be either fixed to a constant level or varied in a step-wise or continuous fashion to different values for different positions depending on the pattern of the image.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
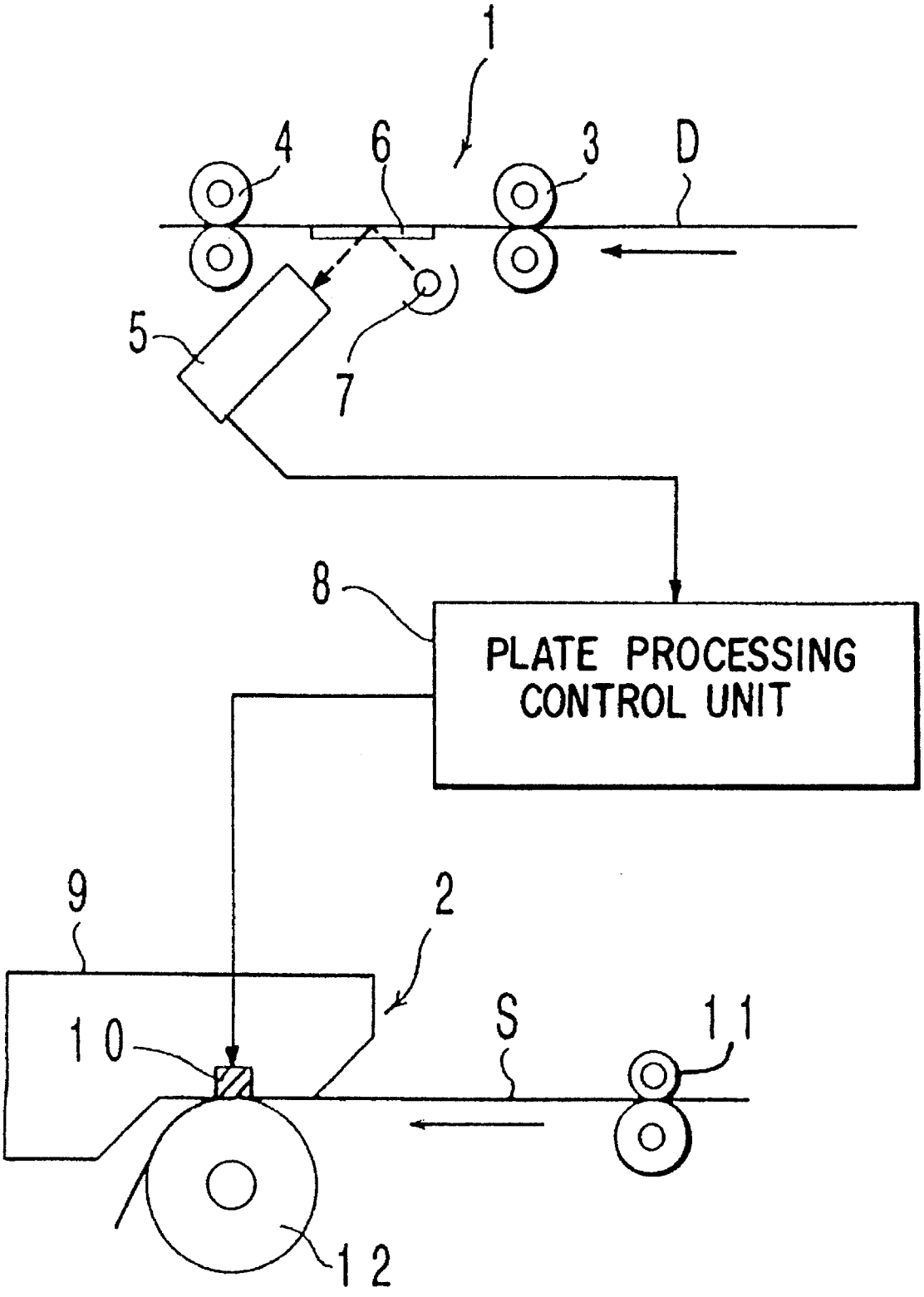
FIG. 1 is a schematic structure view of an example of the device for processing a stencil master plate by using a thermal head which is used for carrying out the method of the present invention.

FIG. 1 shows an example of the device for processing a stencil master plate by using a thermal head which is used for carrying out the method of the present invention. The illustrated device for processing a stencil master plate comprises a scanning unit 1 for scanning original images, and a perforation unit 2 for perforating a stencil master plate.

The scanning unit 1 comprises a CCD sensor 5 which extends linearly in a horizontal scanning direction perpendicular to a feeding direction (vertical scanning direction) of an original D by original feed rollers 3 and 4, and a linear light source 7 which projects light upon a contact glass 6. The CCD sensor 5 receives the light projected from the light source 7 upon the contact glass 6 and reflected by the image on the original D, and supplies an image signal which is photoelectrically converted from the received light to a plate processing control unit 8.

The plate processing control unit 8 is an electronically controlled unit comprising at least an A/D converter, a binary conversion circuit, an arithmetic unit, and a storage circuit. In the plate processing control unit 8, an image signal from the CCD sensor 5 is A/D converted, and is then converted into a binary signal associated with each pixel of the scanning unit 1 (according to a prescribed threshold level). Based on the binary signal associated with each pixel, a heating drive signal associated with each pixel is supplied to a thermal head 9 of the perforation unit 2.

The thermal head 9 of the perforation unit 2 comprises plural minute heat elements 10 arranged in a single row in the horizontal scanning direction at a prescribed pitch which can be selectively and individually heated by the heating drive control signal supplied from the plate processing control unit 8.

The thermal stencil master plate S which is employed in this plate processing device consists of a thermo-plastic resin film and a porous support laminated together, and is conveyed in the direction (vertical scanning direction) indicated by the arrow by being held between conveying rollers 11 until it is finally passed between a platen roller 12 and the thermal head 9.

Thus, each of the heat elements 10 of the thermal head 9 are brought into direct contact with the thermo-plastic resin film of the thermal stencil master plate S so that the thermo-plastic resin film of the thermal stencil master plate S may be perforated in the manner of a dot matrix by selective heating of the heat elements 10 by supplying electric power to the selected heat elements 10.

The method for processing a stencil master plate according to the present invention is characterized by that, in perforating a solid image extending over an region of 3×3 dots or more according to a binary signal associated with each pixel, perforations in this region are partly omitted so as to achieve a certain perforation ratio A (except for a peripheral part of the region) which is within a range of that 50%≦ the perforation ratio A<100%.

The reason for setting the ratio of perforation less than 100% is to avoid the accumulation of heat due to the continuous activation of a part of the heat elements 10 of the thermal head 9 which may occur depending on the pattern of the original image by reducing the perforation ratio or by omitting perforations for some of the pixels whereby the expansion of the perforations, the clogging of the perforations, and the dependency of the condition of the perforations on the pattern of the original image can be removed from the thermo-plastic resin film of the thermal stencil master plate S, and the image can be reproduced on the printing paper without offsetting, unevenness in density or the dependency on the pattern of the original image.

The reason for setting the ratio of perforation at 50% or higher is because the amount of ink deposition in the solid dark region of the printed image otherwise becomes so small that insufficiency in density and impairment of print quality may occur.

In the conventional method without involving the control of the ratio of perforation, the applied energy may be controlled according to the thermal history as a way to control the accumulation of heat. In this case, the applied energy is determined as a mathematical function of the on-off data (digital quantity) of each minute heat elements in question and those adjacent thereto for the current line and the preceding few lines. At this point, due to the restrictions imposed by the number of referred minute heat elements and/or the image processing, the number of possible patterns of the applied energy is limited to only a few. Therefore, according to this method, as the solid dark region of the original image increases, or the number of the pixels that are continuously activated increases, the data on the image pattern out of the referred region is not reflected in the energy application, and it is not possible to control accurately the energy applied according to the amount of heat accumulation for each and every different pattern of the image.

On the other hand, according to the method for processing a stencil master plate based on the present invention, a finer control of heat accumulation is intended through the control of the applied energy according to the thermal history instead of the way described above and the perforation ratio A can be set to an arbitrary value in a continuous manner.

The perforation ratio A may be fixed to a constant value $A_0$ $$A=A_0$$

or may be given as a mathematical function of a state value ($\alpha$)

$$A=A(\alpha)$$

In the method for processing a stencil master plate according to the present invention, the omitting of the perforations in the solid dark region is done by the dither method which represents medium levels of density with binary values. Depending on the condition of the printer and the visco-elastic property of the ink, the insufficiency of density and the unevenness in the solid dark region on the printing paper can be avoided by the saturation of the ink passing through the stencil master plate by appropriately determining the ratio of perforation.

Figure 2A:
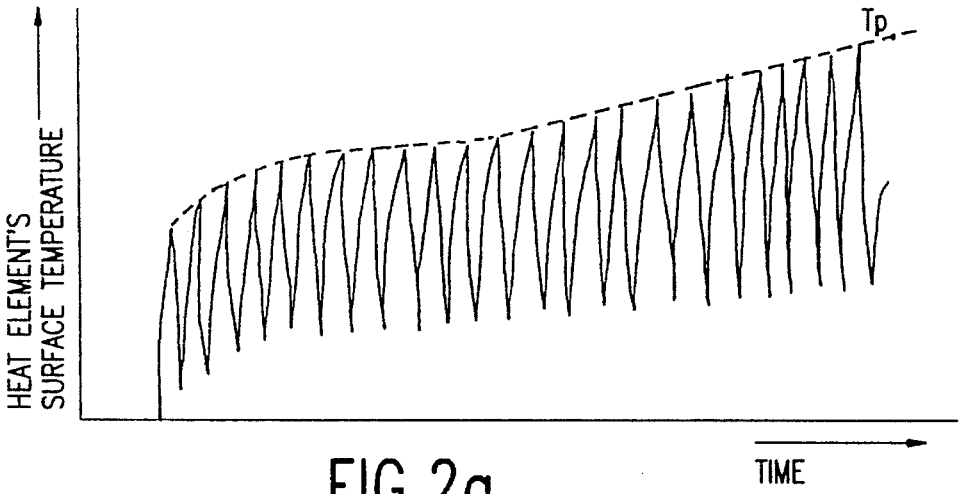
FIG. 2 is a graph showing the time history of the surface temperature of one of the heat elements of the thermal head when processing a solid dark region.
Figure 2B:
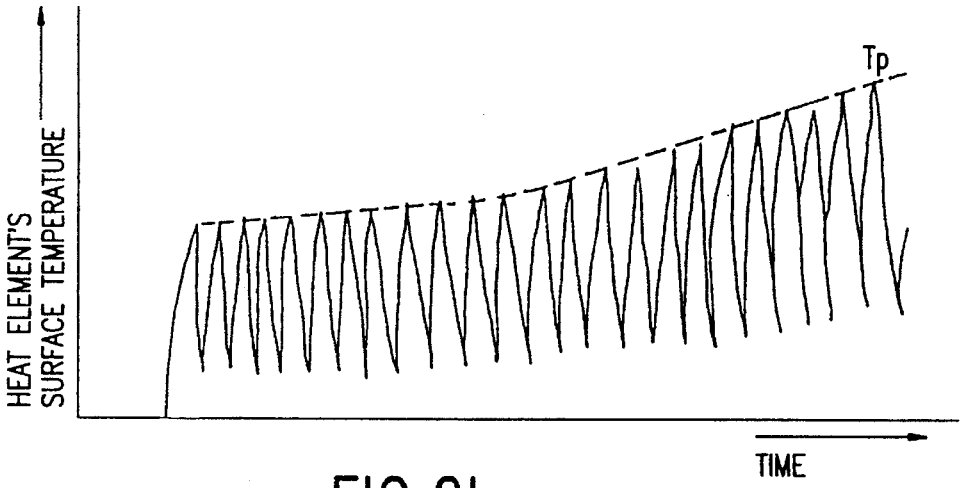
Figure 2C:
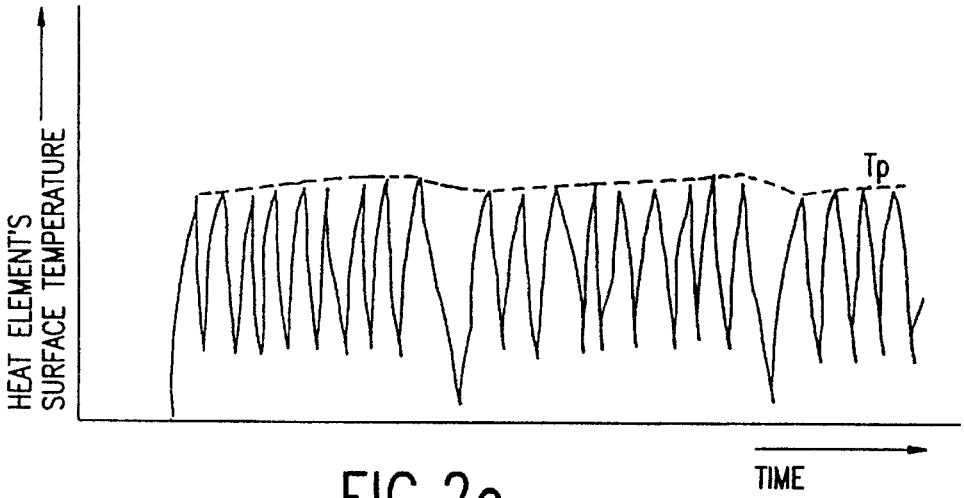

FIGS. 2(*a*) through (*c*) show the time history of the surface temperature of the heat elements of the thermal head in processing a part of the stencil master plate corresponding to the solid dark region.

FIG. 2(*a*) shows a case in which an equal amount of energy is applied at each of the steps. In this case, the peak temperature Tp of the surface temperature continues to rise from the starting point of the solid dark region by heat accumulation. If this condition persists, the heat elements will eventually become over-heated, and problems such as those mentioned above will arise.

FIG. 2(*b*) shows a case in which the amount of energy at the starting point of the solid dark region is temporarily increased according to the thermal history control of the applied energy. In this case, the peak temperature Tp of the surface temperature is more stabilized in an early phase of the solid dark region as compared to the case of (*a*), but eventually increased in the long run due to the accumulation of heat.

FIG. 2(*c*) shows a case in which the control of the perforation ratio according to the present invention is employed in addition to the thermal history control of the applied energy. In this case, the peak temperature Tp of the surface temperature is stabilized in an early phase of the solid dark region, and is confined to the level of the early phase of the solid dark region in the long terms also because the temperature is appropriately reduced immediately after omission of a part of the perforations. Therefore, the gradual increase of temperature due to the accumulation of heat is prevented, and the above mentioned problems is avoided.

Figure 3:
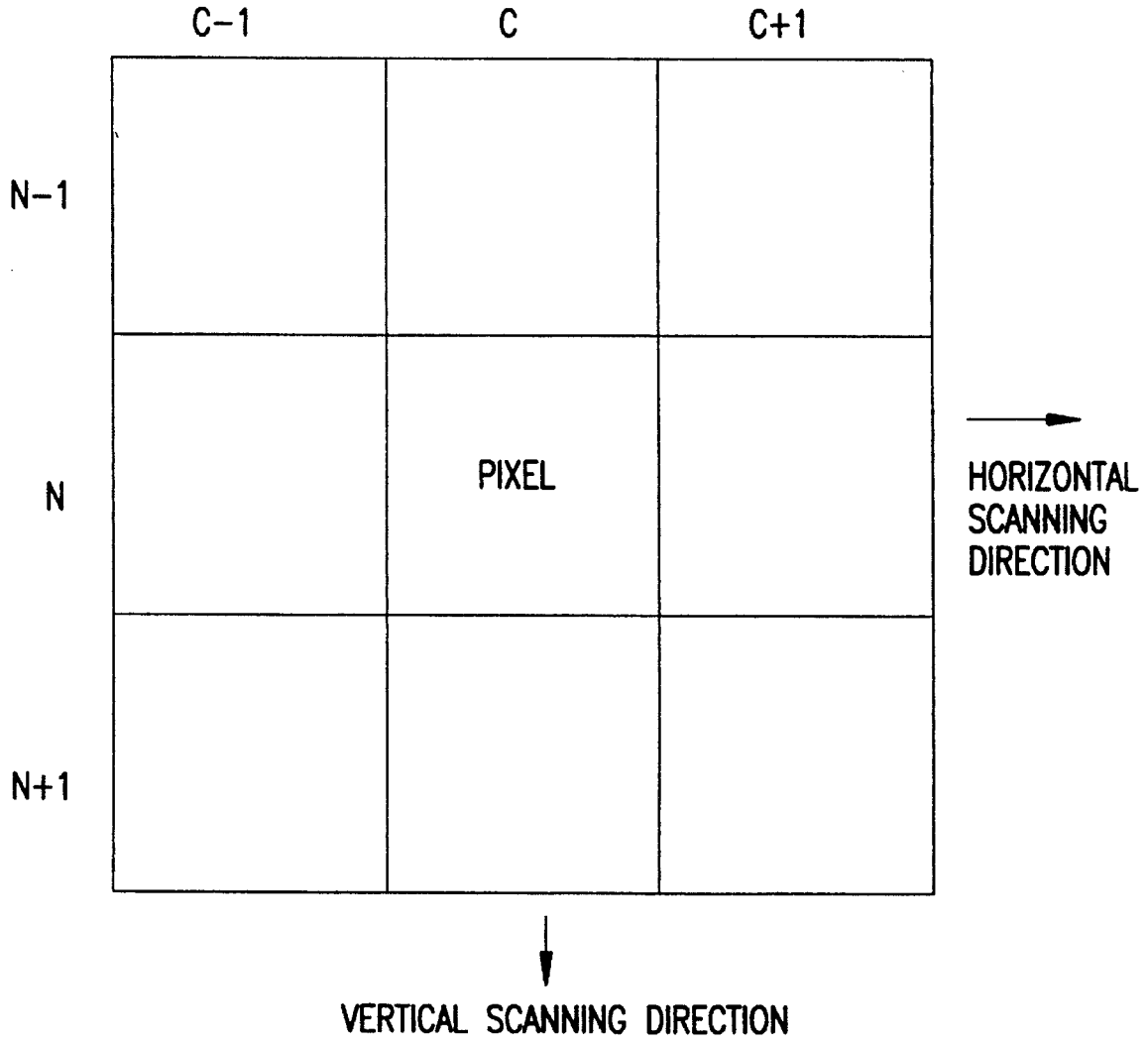
FIG. 3 is an illustrative view of a 3×3 matrix window for describing the process of controlling the ratio of perforation in the method for processing a stencil master plate according to the present invention.

FIG. 3 is a model diagram for illustrating the perforation ratio control in the method for processing a stencil master plate according to the present invention. The pixels (pixel (C, N)) are each replaced by a dither signal for the perforation ratio control when the pixels in a 3×3 matrix window surrounding the pixel in question are all dark.

Figure 4:
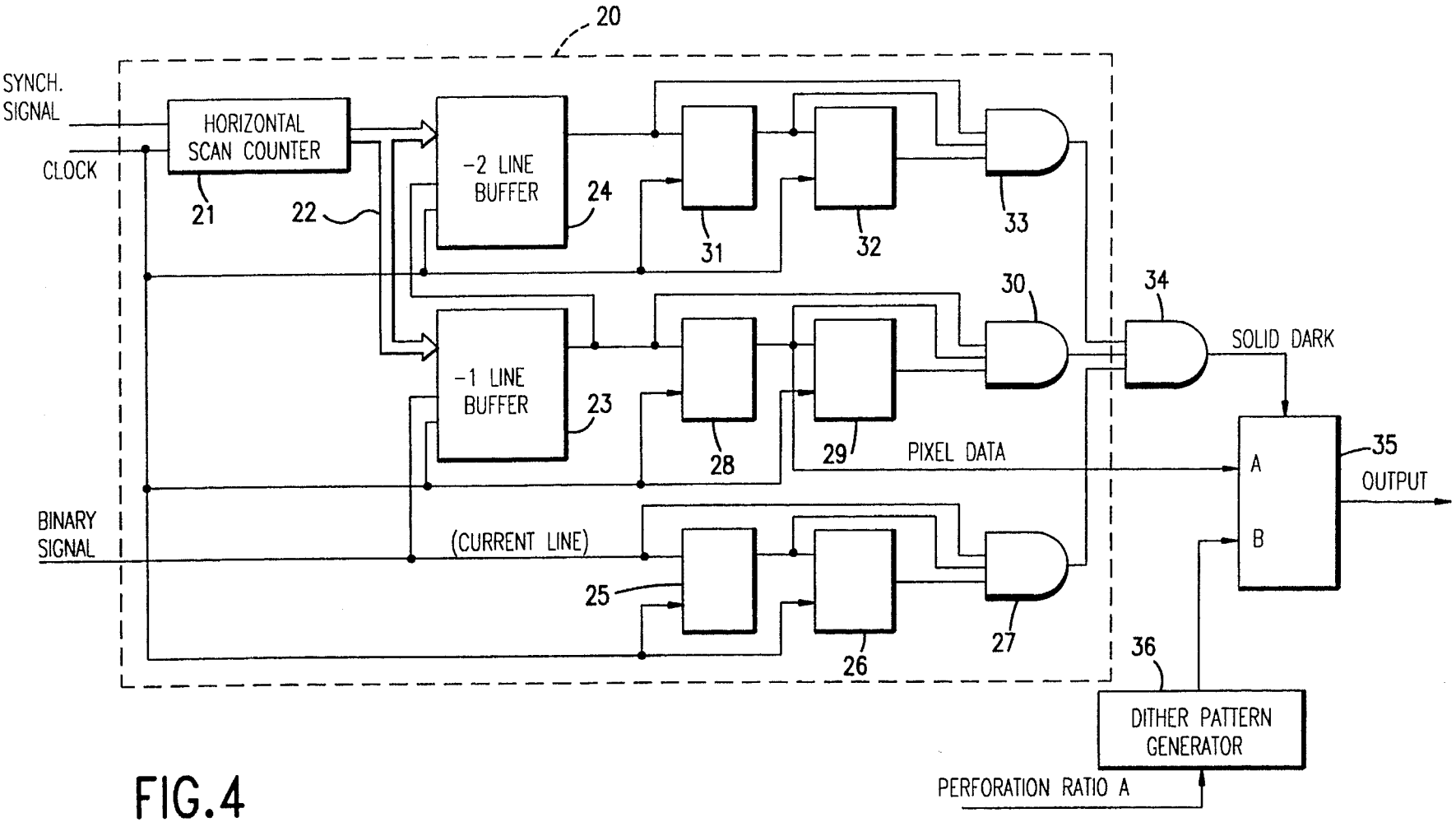
FIG. 4 is a block diagram of an example of the device for processing a stencil master plate which is used for carrying out the method of the present invention.

Now an example of the control device for carrying out the perforation ratio control in the method for processing a stencil master plate according to the present invention is described in the following. FIG. 4 is a block diagram for describing the perforation ratio control according to the present invention. The image signal converted into a binary signal is supplied to a discrimination circuit 20 for a 3×3 window to determine if the pixel (C, N) in question falls within a solid dark region or not. Suppose in the binary signal, "black" is represented by a high level, and "white" is represented by a low level. In the discrimination circuit 20, a synchronization signal and a clock signal are supplied to a horizontal scanning counter 21 which, based on these signals, supplies an address signal for the horizontal scanning direction to a −1 line buffer 23 (a buffer storing data on the line of dot matrix preceding the current line) and a −2 line buffer 24 (a buffer storing data on the line of dot matrix two lines preceding the current line) via an address bus 22. The binary signal supplied to the discrimination circuit 20 is directly inputted to a first-stage latch circuit 25 for the current line, an AND gate circuit 27 and the −1 line buffer 23. A second-stage latch circuit 26 for the current line receives the binary signal from the first stage latch circuit 25. The AND gate circuit 27 receives the binary signals of the input and from the first stage latch circuit 25 and from the second stage latch circuit 26 for the current line, and supplies a signal to the AND gate circuit 34 which is an output gate of the discrimination circuit 20. The −1 line buffer 23 receives the binary signal of the input and supplies it to a first stage latch circuit 28 for the −1 line, an AND gate circuit 30, and the −2 line buffer 24. The first stage latch circuit 28 for the −1 line supplies the binary signal for the pixel (C, N) in a current question to a second stage latch circuit 29 for the −1 line, the AND gate circuit 30 and a selector 35. The AND gate circuit 30 receives binary signals from the first stage latch circuit 28 and the second stage buffer circuit 29 for the −1 line in addition to the binary signal from the −1 line buffer 23, and supplies a signal to the AND gate circuit 34. The −2 line buffer 24 receives the binary signal from the −1 line buffer 23 and supplies it to a first stage latch circuit 31 for the −2 line and the AND gate circuit 33. The first stage latch circuit 31 for the −2 line outputs a binary signal to a second stage latch circuit 32 for the −2 line and the AND gate circuit 33. The AND gate circuit 33 receives binary signals from the first stage latch circuit 31 and the second stage latch circuit 32 for the −2 line in addition to the binary signal from the −2 line buffer circuit 24 to supply its output to the AND gate circuit 34. The −1 line buffer 23, the −2 line buffer 24, and the latch circuits 25, 26, 28, 29, 31 and 32 change their states synchronously with a common clock signal so that the final AND gate circuit 34 in the discrimination circuit 20 supplies a high level signal to the selector 35 when the output signals of the three AND gate circuits 27, 30 and 33 are all at high level or when the pixel in question in the 3×3 window and the pixels surrounding it in the 3×3 window are all black.

The selector 35 replaces the binary signal of the pixel in question with a dither signal from a dither pattern generator 36 for the perforation ratio control when a high level signal is supplied to itself from the AND gate circuit 34, and supplies an output to the heat element 10 of the thermal head 9 corresponding to the designated address as a heating drive signal.

Embodiment 1

Figure 5:
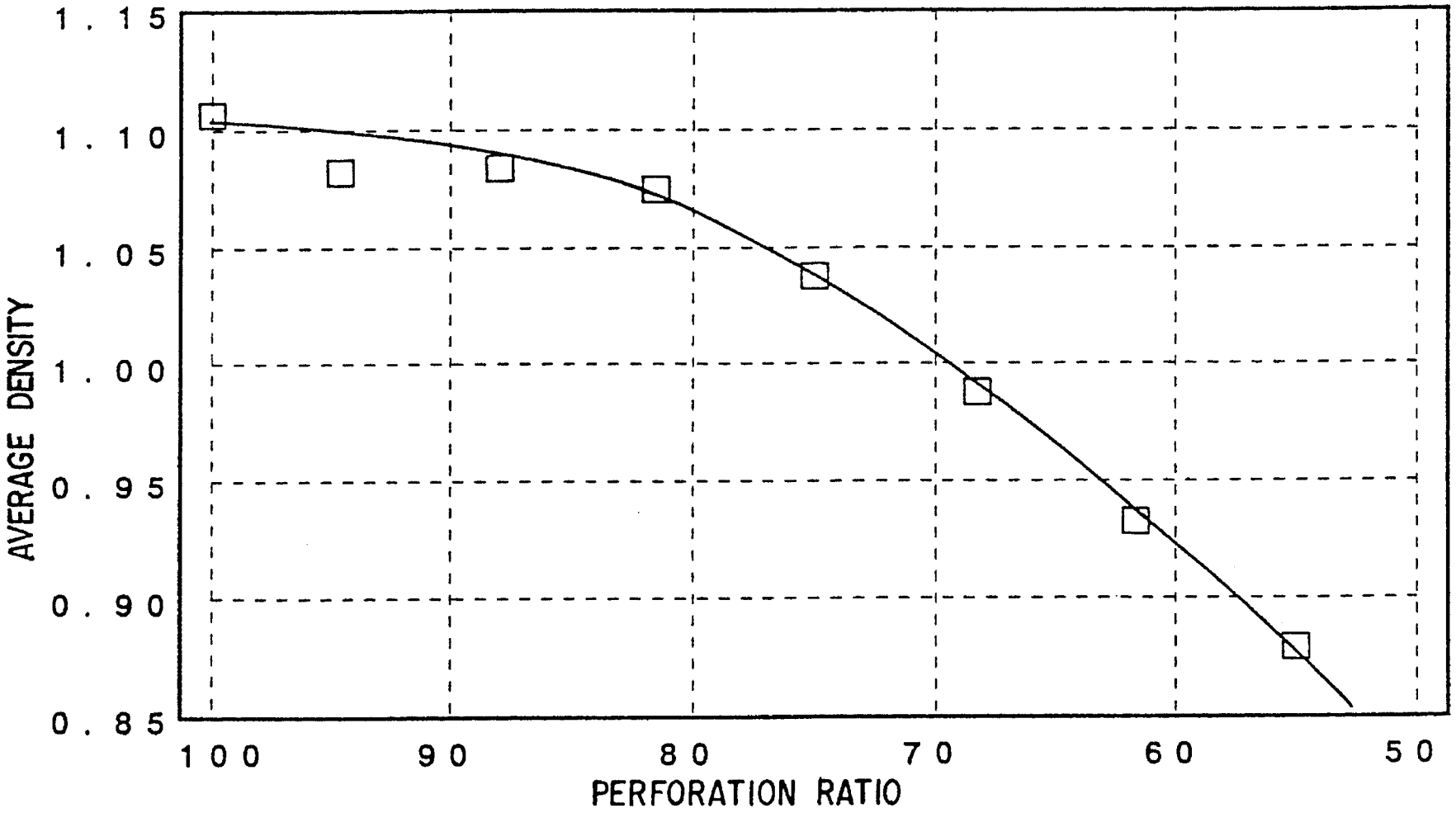
FIG. 5 is a graph showing the average density of a solid dark region in a print in relation to the ratio of perforation.
Figure 6:
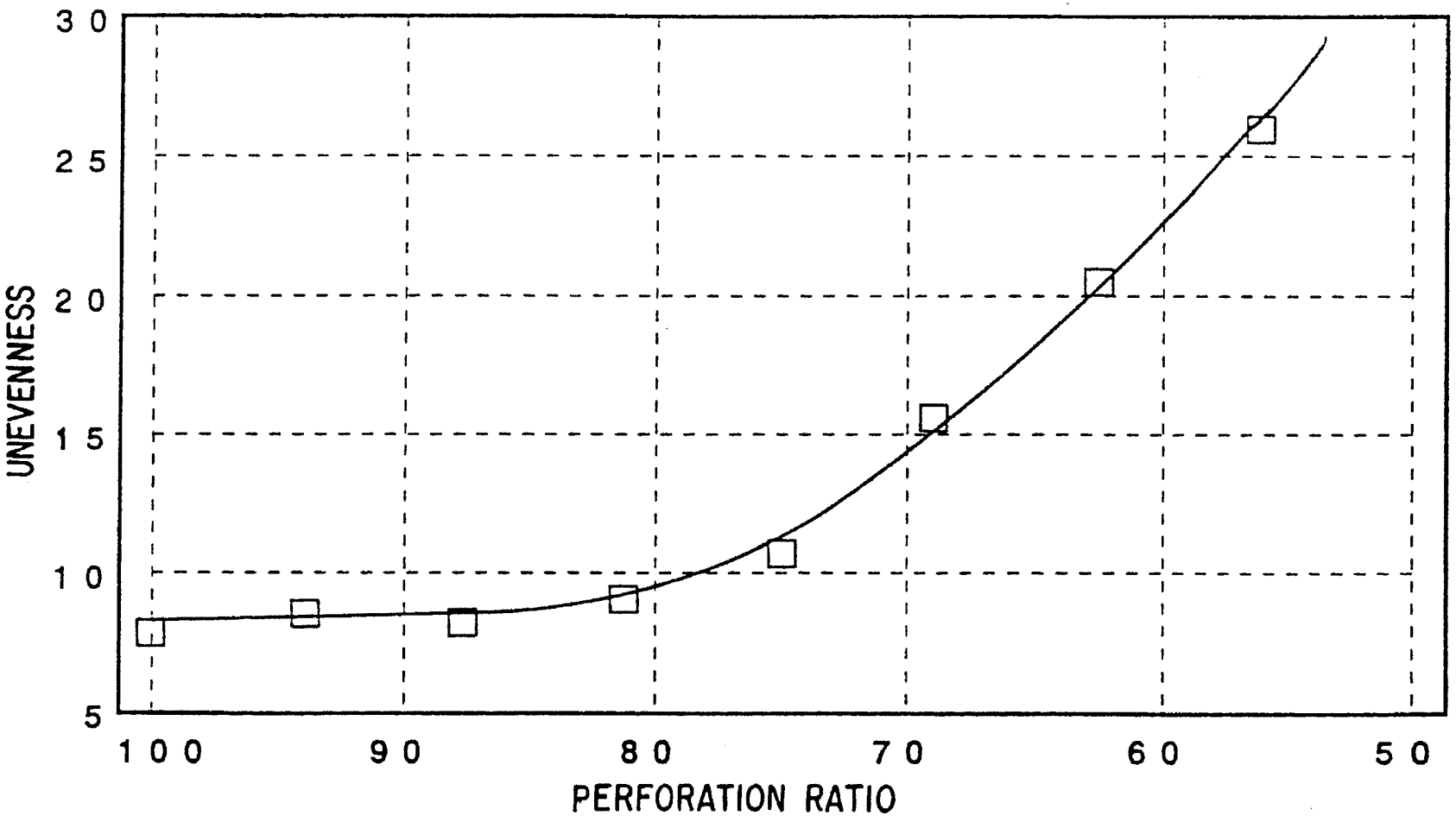
FIG. 6 is a graph showing the unevenness of a solid dark region in a print in relation to the ratio of perforation.
Figure 7:
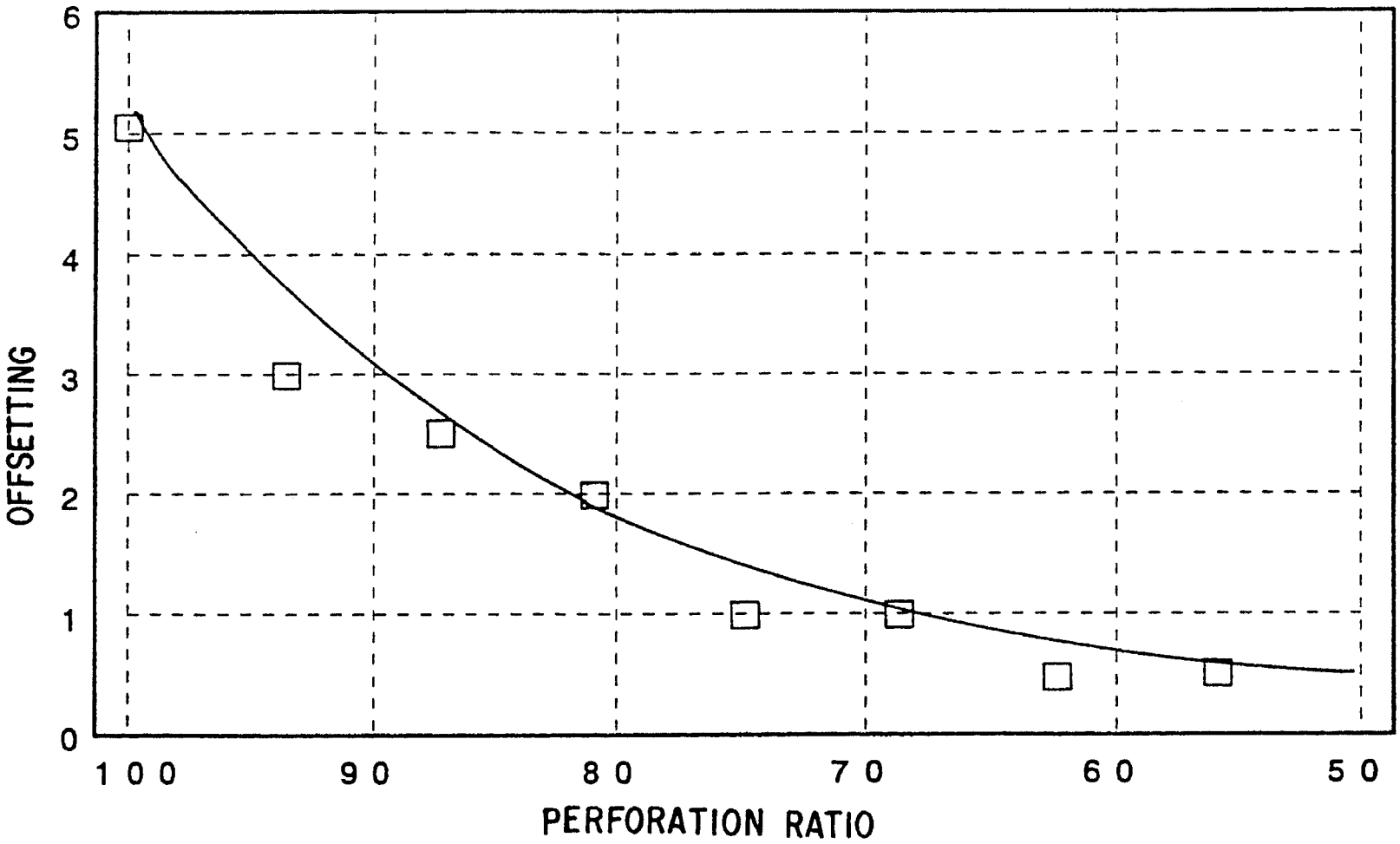
FIG. 7 is a graph showing the result of visual evaluation of the degree of offsetting in relation to the ratio of perforation.

As a basic structure for processing a stencil master plate and stencil printing, Risograph RC115D made by Riso Kagaku Kogyo Kabushiki Kaisha was used, and the dither signal was obtained from the error diffusion pattern generated by an image processing device MN8361 made by Matsushita Denshi Kogyo Kabushiki Kaisha. For the perforation ratio control, a stencil master plate was processed with respect to a certain test chart for different constant perforation ratios with the apparatus described above, and prints were made by using this stencil master plate. In this printing system, to verify the effectiveness of the present invention in eliminating offsetting, a special stencil master plate having a higher ink permeability than a standard stencil master plate was used, and the ink used was more fluid than the standard ink. As a result, the amount of ink deposition was increased compared to the case of using the standard ink, and a stronger tendency to cause offsetting was produced. FIG. 5 shows the average densities of the solid dark region in the printed image for different perforation ratios, FIG. 6 shows the unevenness of the solid dark region in the printed image for different perforation ratios, and FIG. 7 shows the visual evaluation of the degree of offsetting for different perforation ratios.

The "unevenness in the solid dark region" is defined as a standard deviation of the multi-level data for a solid dark region of a 8 mm×8 mm square area on the printing paper consisting of 20 μm×20 μm pixels of 256 halftone levels produced by the image processing device EXCEL-II made by Nippon Avionics KK. The, "unevenness in the solid dark region" may be considered as a degree of the evenness or the blurring of the solid dark region, and the value becomes greater as the unevenness of the solid dark region becomes more severe. The numerical results agree with the results of subjective evaluation.

The "visual evaluation of the degree of offsetting" is given as a zero to five point rating based on visual evaluation of the offsetting of the printed image, and a higher point is given for severe offsetting, the maximum and minimum points being given 5 and 0, respectively.

In this case, when the ratio of perforation is more than 75 or 80%, there is no substantial loss of density in the solid dark region, and the evenness of the solid dark region still exists. Further, there is a great improvement in the rating for the degree of offsetting. As a matter of fact, when a print was made with a perforation ratio of 75%, even though the combination of the ink and the stencil master plate was designed for a higher tendency for offsetting, there was substantially no offsetting, and the evenness of the solid dark region was preserved. In the peripheral part of the solid dark region, since at least one of the eight surrounding pixels is white in the 3×3 window, the data on the pixel (black) in question will remain black, and there is no localized loss of density in the peripheral part of the solid dark region. This is particularly advantageous in printing small character images.

Embodiment 2

The ratio of perforation was a fixed value in Embodiment 1, but it may also be given as a mathematical function of a state value ($\alpha$) depending on the pattern of the original image. When the perforation ratio is given by A, then $$A=A(\alpha).$$

If $\alpha$ is given as an analog value corresponding to the amount of heat accumulation at the pixel in question according to its time history dependent on the pattern of the original image, and is rewritten in a sequential manner according to the on/off of the heat element associated with the pixel in question, the adequate control of heat accumulation is available. It is possible to show one example of the way above, $\alpha$ is calculated in an exclusive circuit according to the past history of the pixel in question and to the thermal transfer from the adjacent regions in the horizontal scanning direction for each step of the past history. The perforation ratio, which is the function A of calculated $\alpha$, is obtained as an output of the dither pattern generator 36 in the control unit of FIG. 4.

Figure 8:
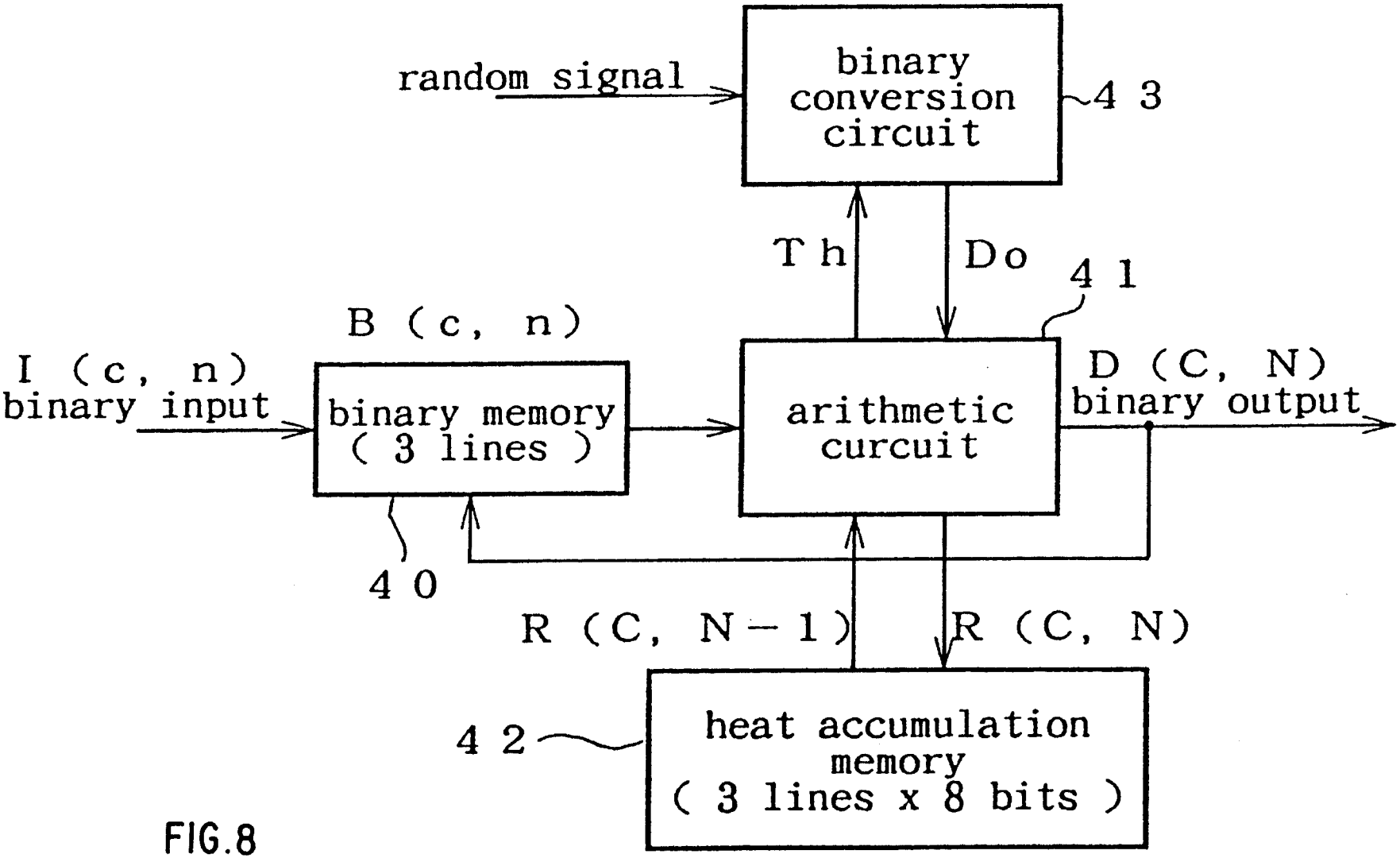
FIG. 8 is a block diagram of an example of the device for processing a stencil master plate which was used for carrying out the method for processing a stencil master plate according to the present invention.

Embodiment 2 based on $A(\alpha)$ is now described in the following with reference to the structure illustrated in FIG. 8. In the aforementioned 3×3 region around the pixel (C, N) in FIG. 3, the horizontal scanning column c is selected from C−1, C and C+1, and the vertical scanning line n is selected from N−1, N and N+1. Referring to FIG. 8, a binary memory 40 has a capacity for three lines along the horizontal scanning direction, and the binary input I (c, n) is sequentially stored as binary memory values B(c, n). When the binary memory 40 has stored all the binary memory values B(c, n) for all combinations of (c, n), as a first step, the arithmetic circuit 41 computes a certain threshold value Th corresponding to the perforation ratio according to the binary memory values B(C, N) from the binary memory 40 and a heat accumulation memory values R (C, N−1) from heat accumulation memory 42 having a capacity for 8 bits two lines of data along the horizontal scanning direction, and supplies it to the binary conversion circuit 43. The binary conversion circuit 43 supplies an outcome of the process of converting the random signal according to the threshold value Th from the arithmetic circuit 41 into a binary signal as $D_0$. As a second step, the arithmetic circuit 41 computes and outputs a binary output signal D(C, N) according to the result $D_0$ (dither signal) of the binary conversion from the binary conversion circuit 43 followed by the rewriting of the binary memory value B(C, N) of the binary memory 40, and computes the amount of heat accumulation R(C, N) at the dot before supplying it to the heat accumulation memory 42.

I, B and D are binary values, and white (not heated) is represented by 0 while black (heated) is represented by 1. The amount of heat accumulation $\alpha$ given as an analog signal is stored in the heat accumulation memory 42 as a heat accumulation memory value R, where no heat accumulation is represented by 0/255 while the maximum heat accumulation is represented by 255/255.

Figure 9:
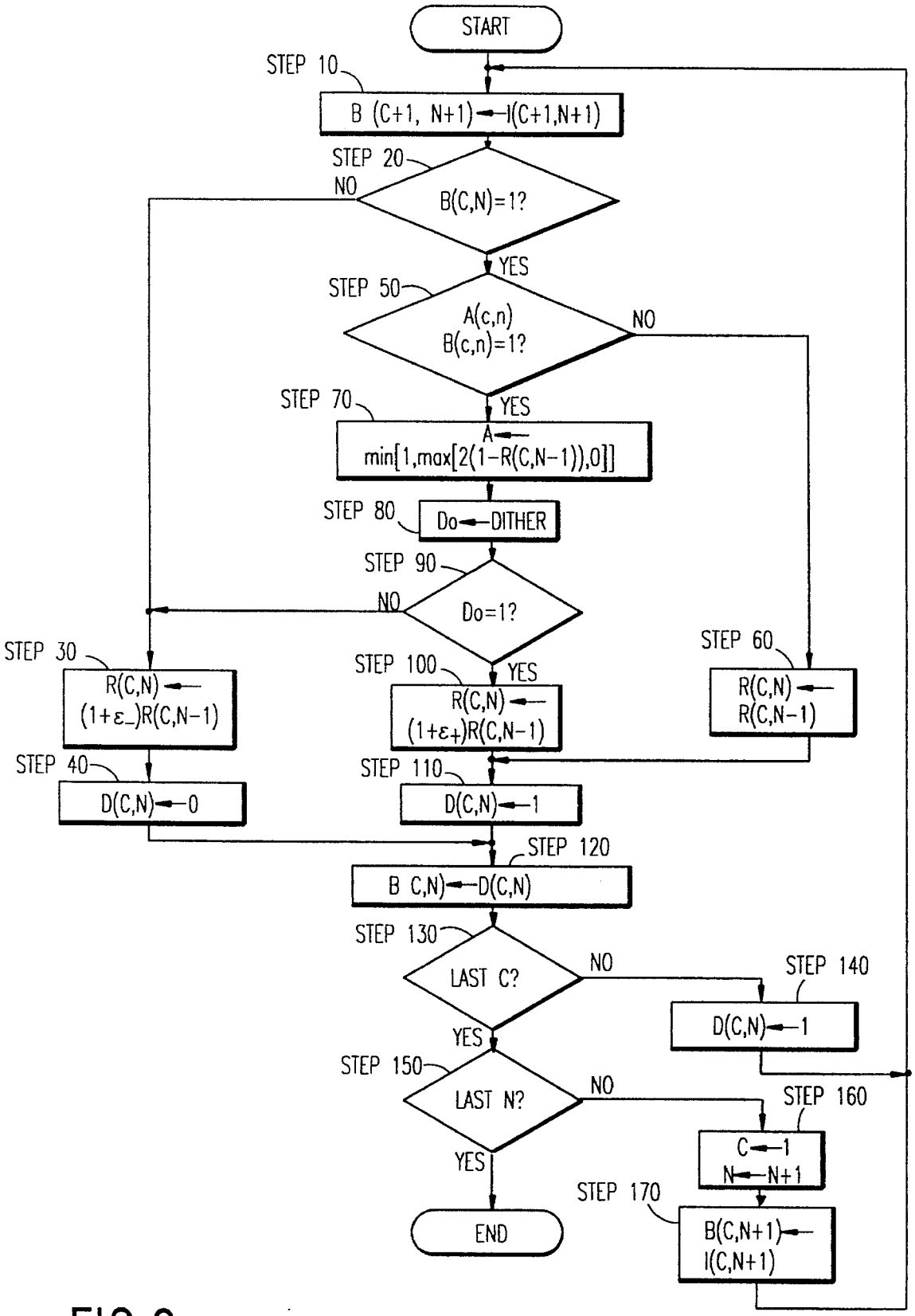
FIG. 9 is a flow chart showing an example of the process flow of the perforation ratio control in the method for processing a stencil master plate according to the present invention.

The flow of this process is illustrated in FIG. 9. Referring to the flow chart of FIG. 9, the mode of operation is now described in the following.

First of all, the value of the binary input I(C+1, N+1) at a reference pixel (C+1, N+1) is stored as a binary memory value B(C+1, N+1) (step 10).

Then, it is determined if the binary memory value B(C, N) is 1 or not (step 20), and, if the binary memory value B(C, N) is 0, the heat accumulation memory value R(C, N−1) is incremented by $\epsilon_-$(R(C, N−1)) with respect to the heat accumulation memory value R(C, N−1) for the −1 line (step 30), and the binary output D(C, N) is set to 0 (step 40). Here, $\epsilon_-$ is an operator applied to R, and $\epsilon_-$(R(c, n)) is equal to −R(c, n)(1−a) where a is a fixed value defined by 0<a<1.

If the binary memory value B(C, N) for the pixel is 1 in step 20, it is determined if all of the binary memory values B(c, n) of the 3×3 region are 1 or not (step 50). If any one of the surrounding pixels is 0, the accumulated heat memory value R(C, N) is made to equal to the accumulated heat memory value R(C, N−1) for the −1 line (step 60). In this case, the condition for the black region does not apply, and the binary output D(C, N) is 1 (step 110).

If all of the surrounding pixels are 1 in step 50, one pulse of the dither signal corresponding to a ratio of perforation A=min [1, max [2(1−R(C, N−1)),0]] determined by the accumulation heat memory value R(C, N−1) is produced, and it is temporarily stored as $D_O$ (steps 70 and 80). This dither signal may be a signal obtained by converting a random signal of 256 levels ranging from 0 to 255 into a binary signal with a threshold value Th=255(1−A).

Then, it is determined if the dither signal $D_0$ is 1 or not (step 90). If $D_O$ is 0, it is essentially the same as the case where the binary memory value B(C, N) is 0, and, in this case, the heat accumulation memory value R(C, N) is incremented by $\epsilon_-$(R(C, N−1)) with respect to the heat accumulation memory value R(C, N−1) for the −1 line (step 30), and the binary output D(C, N) is set to 0 (step 40).

On the other hand, if $D_0$ is 1, the heat accumulation memory value R(C, N) is incremented by $\epsilon_+$(R(C, N−1)) with respect to the heat accumulation memory value R(C, N−1) for the −1 line (step 100), and the binary output D(C, N) is set to 1 (step 110). Here, $\epsilon_+$ is an operator applied to R, and $\epsilon_+$(R(c, n)) is equal to (1−R(c, n))(1−a) where a is a fixed value defined by 0<a<1.

Thereafter, the binary output D(C, N) of the pixel is stored in the binary memory B(C, N) (step 120).

The pixel (C, N) is then shifted by +1 in the horizontal scanning direction, and the values of the 3×3 window are updated with the corresponding values. If the pixel is located at a terminal end of the horizontal scanning direction, the new pixel is moved to the first column of the next line, and the binary input ((C, N+1) for the pixel (C, N+1) is stored in the binary memory value B(C, N+1) with respect to new C and N (steps 130 to 170). If the pixel is on an edge of the frame, and the 3×3 window cannot be defined within the frame, the binary memory values B and the accumulated heat memory values R falling out of the frame are both set to 0.

$\epsilon_+$ and $\epsilon_-$ may be determined by assuming that the increase and the decrease of the heat accumulation is in proportion to the exponent of the integral of the cumulative pulses. a is an experimentally determined value depending on the condition of heat dissipation, and, in the case of the embodiments of the present invention, setting the value of a to approximately 0.93 produced favorable results in terms of the print quality (density, offsetting and evenness of solid dark regions).

Practically, Risograph RC115D made by Riso Kagaku Kogyo KK with the perforation ratio control circuit to carry out the above mentioned algorithm was used as the basic structure for processing stencil master plates and making prints by using such stencil master plates. As a process for controlling the perforation ratio according to the present invention, in a stencil master plate was formed with various ratios of perforation for different original patterns of the test chart, and prints were made with this stencil master plate.

In the same way as in Embodiment 1, to verify the effectiveness of the present invention in regard to offsetting, the employed stencil master plate had a greater ink permeability than the standard stencil master plate, and the employed ink had a higher fluidity than the standard ink. When a print was obtained with a =0.93, even though it is designed for higher tendency for offsetting, there was substantially no offsetting, and the evenness of solid dark regions was satisfactory. Further, in regard to the solid dark regions which accounted for a large part of the obtained print, the condition of the perforations in the stencil master plate was uniform throughout the regions owing to the perforation ratio control according to the amount of heat accumulation so that a uniform reproduction was achieved in all of the solid dark regions. In the peripheral part of the solid dark region, since at least one of the eight surrounding pixels is white in the 3×3 window, the data on the pixel (black) in question will be ensured to remain black, there is no localized loss of density in the prints of such images as small characters.

As can be understood from the above description, according to the method for processing a stencil master plate according to the present invention, when an region of 3×3 dots or larger of a stencil master plate is to be perforated and processed as a solid dark region, the perforations within this region are omitted at a certain ratio of perforation except for the peripheral region of this region so that the minute heat elements may not be over-heated, and the heat sensitive film may be not subjected to a level of heat which is more than necessary for perforation. Thus, the formation of perforations larger than intended is prevented, and the resulting favorable control of the amount of ink deposition prevents offsetting, and the resulting prevention of the clogging of the perforations eliminates any unevenness in the density in the prints with the overall result that a high print quality can be obtained not depending on the pattern of the original images.

Although the present invention has been described in terms of preferred embodiments thereof, it is obvious to a person skilled in the art that various alterations and modifications are possible without departing from the scope of the present invention which is set forth in the appended claims.

What I claim is:

1. A method for processing a thermal stencil master plate by perforating a heat sensitive film of said thermal stencil master plate using a thermal head having a plurality of heat elements, comprising:

scanning an image for image information;

processing the image information such that solid dark regions of the image are identified, said solid dark regions having peripheral parts; and perforating said thermal stencil master plate such that the image is reproduced and at least a portion of said solid dark regions other than the peripheral parts of said solid dark regions are perforated at a specified perforation ratio;

wherein said perforation of said portion of said solid dark regions is carried out at said specified perforation ratio when the peripheral parts of said solid dark regions surrounding said portion are all dark.

2. The method of claim 1, wherein said peripheral parts of said solid dark regions are perforated at a perforation ratio that is different than said specified perforation ratio.

3. A method for processing a thermal stencil master plate by perforating a heat sensitive film of said thermal stencil master plate using a thermal head having a plurality of heat elements, comprising:

scanning an image for image information;

converting the image information into a digital signal;

identifying regions of the image wherein areas of a specified size are of a solid dark color, said solid dark areas having peripheral parts; and reproducing the image on said thermal stencil master plate such that at least a portion of said solid dark areas other than the peripheral parts of said solid dark areas are perforated at a specified perforation ratio;

wherein said perforation of said portion of said solid dark areas is carried out at said specified perforation ratio when the peripheral parts of aid dark areas surrounding said portion are all dark.

4. The method of claim 3, wherein said peripheral parts of said solid dark areas are perforated at a perforation ratio that is different than said specified perforation ratio.

5. The method of claim 4, wherein said regions consist of sequential n×n matrices of pixels, where n is at least three.

6. The method of claim 4, wherein said perforation ratio that is different than said specified perforation ratio is 50% or greater but less than 100%.

7. The method of claim 3, wherein said regions consist of sequential n×n matrices of pixels, where n is at least three.

8. The method of claim 3, wherein said specified perforation ratio is 50% or greater but less than 100%.

9. A method for processing a thermal stencil master plate by perforating a heat sensitive film of said thermal stencil master plate using a thermal head having a plurality of heat elements, comprising:

scanning an image for image information;

converting the image information into a digital signal consisting of binary signals representing sequential 3×3 matrices of pixels having a center pixel;

identifying regions of the image wherein sequential areas represented by said sequential 3×3 matrices of pixels are dark, solid and unbroken;

substituting a dither signal selected to produce a certain perforation ratio for the binary signal of the pixel located in said center of each said 3×3 matrix of pixels when each said 3×3 matrix of unbroken;

reproducing the image on said thermal stencil master plate by activating the thermal head according to said dither signal when each said 3×3 matrix of said pixels is dark and according to said binary signal when at least one of each said 3×3 matrix of said pixels is not dark, whereby the dark image of the pixel located in said center of each said 3×3 matrix of said pixels is perforated at said certain perforation ratio according to said dither signal when each said 3×3 matrix of said pixels is dark and the dark image of the pixel located in said center of each said 3×3 matrix of said pixels is perforated according to said binary signal when at least each said 3×3 matrix of said pixels is not dark.

10. The method of claim 9, wherein said certain perforation ratio is 50% or greater but less than 100%.

11. The method of claim 9, wherein said dither signal is selected based on a calculation of heat accumulation in said heat elements thereby producing a certain variable perforation ratio.

12. A method for processing a thermal stencil master plate by perforating a heat sensitive film of said thermal stencil master plate using a thermal head having a plurality of heat elements, comprising:

scanning an image for image information;

converting the image information into a digital signal consisting of binary signals representing sequential 3×3 matrices of pixels having a center pixel;

identifying regions of the image wherein sequential areas represented by said sequential 3×3 matrices of pixels are dark, solid and unbroken;

modifying said digital signal by substituting a dither signal selected to produce a certain perforation ratio for the binary signal of the pixel located in said center of each said 3×3 matrix of pixels that is dark, solid and unbroken;

reproducing the image on said thermal stencil master plate by activating the thermal head according to said modified digital signal, whereby said binary signal of the pixel located in the center of each said 3×3 matrix of pixels perforates said solid areas at said certain perforation ratio.

* * * * *